US007512035B2

(12) United States Patent
Sugahara

(10) Patent No.: US 7,512,035 B2
(45) Date of Patent: Mar. 31, 2009

(54) PIEZOELECTRIC ACTUATOR, LIQUID TRANSPORTING APPARATUS, AND METHOD OF PRODUCING PIEZOELECTRIC ACTUATOR

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 117 days.

(21) Appl. No.: 11/385,724

(22) Filed: Mar. 22, 2006

(65) Prior Publication Data

US 2006/0214536 A1 Sep. 28, 2006

(30) Foreign Application Priority Data

Mar. 22, 2005 (JP) ..... 2005-081009

(51) Int. Cl.
*H04R 7/00* (2006.01)

(52) U.S. Cl. ..... 367/70; 310/311; 367/68

(58) Field of Classification Search ..... None
See application file for complete search history.

(56) References Cited

U.S. PATENT DOCUMENTS

| | | | | |
|---|---|---|---|---|
| 5,754,205 | A | 5/1998 | Miyata et al. | |
| 5,922,218 | A | 7/1999 | Miyata et al. | |
| 5,923,352 | A * | 7/1999 | Kikuchi et al. | 347/70 |
| 6,089,701 | A | 7/2000 | Hashizume et al. | |
| 6,142,614 | A | 11/2000 | Hashizume et al. | |
| 6,174,051 | B1 * | 1/2001 | Sakaida | 347/72 |
| 2004/0060969 | A1 * | 4/2004 | Imai et al. | 228/180.21 |
| 2004/0119790 | A1 | 6/2004 | Taira | |
| 2006/0023436 | A1 * | 2/2006 | Sugahara | 361/760 |
| 2006/0065701 | A1 * | 3/2006 | Kobayashi | 228/193 |

FOREIGN PATENT DOCUMENTS

| | | | |
|---|---|---|---|
| EP | 1 512 534 | * | 8/2004 |
| EP | 1512534 A1 | | 3/2005 |
| JP | 9156099 | | 6/1997 |
| JP | 9327912 | | 12/1997 |
| JP | 10211701 | | 8/1998 |
| JP | 10226071 | | 8/1998 |
| JP | 2004136668 | | 5/2004 |
| JP | 1 512 534 | * | 3/2005 |

OTHER PUBLICATIONS

European Patent Office, European Search Report for Related Application No. EP 06005759, dated Aug. 10, 2007.

* cited by examiner

*Primary Examiner*—Thomas M Dougherty
*Assistant Examiner*—Bryan P Gordon
(74) *Attorney, Agent, or Firm*—Baker Botts L.L.P.

(57) ABSTRACT

A piezoelectric actuator includes a vibration plate covering pressure chambers and serving also as a common electrode, a piezoelectric layer arranged entirely on the upper surface of the vibration plate, an insulating layer formed entirely on upper surfaces of individual electrodes and the piezoelectric layer, and wirings formed on the upper surface of the insulating layer. A through hole is formed in the insulating layer at an area facing both one of the individual electrodes and one of the wirings, and the individual electrode and the wiring are connected by an electroconductive material filled in the through hole. With this, both the simplification of structure of electric contact and the improvement in reliability of electric connection can be realized, and a piezoelectric actuator is capable of suppressing the generation of excessive electrostatic capacitance during the application of drive voltage can be provided.

16 Claims, 17 Drawing Sheets

PIEZOELECTRIC ACTUATOR, LIQUID TRANSPORTING APPARATUS, AND METHOD OF PRODUCING PIEZOELECTRIC ACTUATOR

BACKGROUND OF THE INVENTION

1. Field of the Invention

The present invention relates to a piezoelectric actuator for a liquid transporting apparatus which transports a liquid, a liquid transporting apparatus provided with a piezoelectric actuator, and a method of producing piezoelectric actuator.

2. Description of the Related Art

An ink-jet head which discharges ink from nozzles onto a recording medium such as a recording paper is an example of a liquid transporting apparatus which transports a liquid by applying pressure to the liquid. Such an ink-jet head includes a piezoelectric actuator which is arranged on one surface of a channel unit provided with a plurality of pressure chambers communicating with the nozzles respectively, and which changes selectively volume of the pressure chambers (see, for example, U.S. Patent Application Publication No. US2004/119790 A1 corresponding to Japanese Patent Application Laid-open Publication No. 2004-136668; U.S. Pat. Nos. 5,754,205 and 5,922,218 corresponding to Japanese Patent Application Laid-open Publication No. 9-156099; and US Patent Application Publication No. US2004/0060969 A1).

A piezoelectric actuator of an ink-jet head described in U.S. Patent Application Publication No. US2004/119790 A1 includes a piezoelectric layer (piezoelectric sheet) arranged continuously over the pressure chambers, a plurality of individual electrodes formed corresponding to the pressure chambers respectively, on a surface of the piezoelectric layer, and a common electrode sandwiching the piezoelectric layer between the individual electrodes and the common electrode. A plurality of land portions are formed on the plurality of individual electrodes respectively, and a contact portion of a flexible printed circuit (FPC) is electrically connected to the plurality of land portions. Further, a drive voltage is applied selectively to the individual electrodes from a drive unit (driver IC) via the FPC.

On the other hand, in an ink-jet head described in U.S. Pat. Nos. 5,754,205 and 5,922,218, a plurality of drive electrodes (upper drive electrodes and lower drive electrodes) are formed on the surface of a piezoelectric layer (piezoelectric film) which is arranged continuously over the pressure chambers (pressurizing chambers), and a wiring is extended from each of these drive electrodes. The plurality of wirings are drawn in one predetermined direction in a wiring area adjacent to a displacement area on the surface of the piezoelectric layer. In the wiring area, the drive electrodes are arranged and are connected to a printed circuit. In this case, in order to prevent, when a voltage is applied to the drive electrodes, the generation of excessive electrostatic capacitance (parasitic capacitance) between the piezoelectric layer sandwiched between the wirings and the drive electrodes, a low dielectric layer is provided at the wiring area between the piezoelectric layer and the wires.

Further, in an ink-jet head described in U.S. Patent Application Publication No. US2004/0060969 A1, a flexible printed circuit is connected to a plurality of head terminals of the ink-jet head. The flexible printed circuit includes an insulating member in the form of a flexible belt, a plurality of terminal lands which are arranged in a row on one surface of the insulating member, corresponding to a plurality of head terminals of the ink-jet head, and a plurality of lead wirings each of which is wired independently to one of the terminal lands, on the surface of the insulating member where the terminal lands are arranged in a row. Through holes, penetrating through the insulating member, are formed at positions in each of which one of the terminal lands of the insulating material is arranged. Through these through holes, the terminal lands are respectively exposed to other surface of the insulating member. After filling an electroconductive material such as solder into the through holes formed in the insulating member, and positioning the terminal lands of the flexible printed circuit and the head terminals of the ink-jet head to face one another, the terminal lands and the head terminals are connected by the electroconductive material in the through holes. At this time, since the electroconductive material in each of the through holes, a terminal land adjacent to the electroconductive material in one of the through holes, and a lead wiring wired to the adjacent terminal land are isolated from one another by the insulating member, there is no fear of a short circuit.

SUMMARY OF THE INVENTION

In recent years, to satisfy both the demands for improvement in printing quality and reduction in the size of ink-jet head, attempts have been made to arrange a plurality of pressure chambers in a high density, but when an attempt is made to arrange the pressure chambers in a high density, it is also necessary to arrange a plurality of individual electrodes in a high density. However, when an ink-jet head is structured such that a drive voltage is supplied to the individual electrodes from a drive unit via a wiring member such as an FPC, as in the ink-jet head described in U.S. Patent Application Publication No. US2004/119790 A1, since it is necessary to form, in high density, a wiring pattern of the wiring member which is connected to the land portions of the individual electrodes, a cost of the wiring member becomes high. Moreover, since contact portions of the wiring member is connected to each of the land portions with a wiring member such as the FPC is arranged to cover the land portions of the individual electrodes arranged flatly, when an external force acts on the wiring member, the wiring member tends to be exfoliated, and a reliability of electric connections between the individual electrodes and the wiring member is low.

Further, also in the ink-jet head described in US Patent Application Publication No. 2004/0060969 A1, when the pressure chambers of the ink-jet head are arranged in a high density, it is necessary to form the wiring pattern of the flexible printed circuit in a high density. Accordingly, the cost of the flexible printed circuit becomes high. Furthermore, since the ink-jet head and the flexible printed circuit are connected only at portions between the head terminals of the ink-jet head and the corresponding land terminals of the flexible printed circuit, there involves a problem that when an external force acts on the flexible printed circuit, the flexible printed circuit tends to be exfoliated.

On the other, in an ink-jet head described in U.S. Pat. Nos. 5,754,205 and 5,922,218, a plurality of wirings are drawn to the wiring area from the plurality of drive electrodes, and the drive unit (printed circuit) and the drive electrodes are connected via these wirings. Accordingly, the reliability of electric connections is higher as compared to a structure using the FPC mentioned above. In this case, when the number of pressure chambers is small, it is easy to arrange, only in the wiring area, the plurality of wirings extending respectively from the electrodes arranged in the displacement area. When a large number of pressure chambers are arranged in a high density, however, a part of wiring has to be arranged in the displacement area in which no low dielectric layer is formed.

And, at this time, excessive electrostatic capacitance is generated in the piezoelectric layer at the displacement area which directly contacts with the wirings to which the electric voltage is applied.

An object of the present invention is to provide a piezoelectric actuator which can realize both of the simplification of structure of electric connections for applying the drive voltage to the piezoelectric layer and the improvement in reliability of the electric connections, and which is capable of further suppressing the generation of excessive electrostatic capacitance when the drive voltage is applied, a method of producing the piezoelectric actuator, and a liquid transporting apparatus in which the piezoelectric actuator is used.

According to a first aspect of the present invention, there is provided a piezoelectric actuator for a liquid transporting unit, which is arranged on one surface of a channel unit in which a liquid channel including a plurality of pressure chambers arranged along a plane is formed, and which selectively changes a volume of the pressure chambers, the piezoelectric actuator including: a vibration plate which covers the pressure chambers; a common electrode which is formed on a surface of the vibration plate on a side opposite to the pressure chambers; a piezoelectric layer which is arranged continuously on a surface of the common electrode on a side opposite to the pressure chambers, so that the piezoelectric layer wholly covers the pressure chambers thereover; an insulating layer which is formed entirely on a surface of the piezoelectric layer on a side opposite to the pressure chambers; and wirings which are formed, on a surface of the insulating layer on a side opposite to the pressure chambers, corresponding to the pressure chambers respectively, wherein: a first through hole is formed in the insulating layer at an area facing one of the wirings; and the first through hole is filled with an electroconductive material which is connected to one of the wirings.

In the piezoelectric actuator of the first aspect of the present invention, the electroconductive material, which is filled in the first through hole penetrating through the insulating layer and which reaches up to the upper surface of the piezoelectric layer, and the drive unit which supplies the drive voltage to the electroconductive material are connected via the plurality of wirings formed on the flat surface of the insulating layer. Therefore, the structure of electric connections for supplying the drive voltage from the drive unit is simplified, and furthermore, it is possible to omit a wiring member such as an FPC. Since the insulating layer and the piezoelectric layer are adhered tightly without any gap between the insulating layer and the piezoelectric layer, the mechanical strength of the insulating layer with respect to a force pulling apart the insulating layer and the piezoelectric layer is extremely high. Therefore, the wirings formed on the surface of the insulating layer have a high mechanical strength with respect to the external force as compared to the wiring member such as the FPC. Therefore, reliability of mechanical connections and electric connections becomes higher as compared to a case in which the drive unit and the individual electrodes are connected via a wiring member such as the FPC which is arranged flatly on the surface of the individual electrodes. Furthermore, it is possible to suppress the generation of excessive electrostatic capacitance in the piezoelectric layer at portions sandwiched between the wirings and the common electrode. Moreover, since the piezoelectric layer is protected by the insulating layer, the piezoelectric layer is hardly damaged during the manufacturing process. The present invention includes an aspect in which the vibration plate is electroconductive, and a surface of the vibration plate on the side opposite to the pressure chamber also serves as a common electrode.

In the piezoelectric actuator of the present invention, at least a portion of each of the wirings may face a pressure chamber corresponding thereto and included in the pressure chambers; the first through hole may be formed at an area of the insulating layer, the area facing both one of the wirings and one of the pressure chambers; and the electroconductive material filled in the first through hole may reach up to the surface of the piezoelectric layer on the side opposite to the pressure chambers. In this case, for example, even when no individual electrode is provided between the insulating layer and the surface of the piezoelectric layer on the side opposite to the pressure chambers, the electroconductive material which is filled in each of the first through holes and which reaches up to the surface of the piezoelectric layer on the side opposite to the pressure chambers serves as the individual electrode. In other words, when the drive voltage is applied to the electroconductive material which is filled in the first through hole penetrated through the insulating layer, and which extends up to the upper surface of the piezoelectric layer, an electric field acts in the piezoelectric layer between the electroconductive material and the common electrode, and the piezoelectric layer is deformed. When the piezoelectric layer is deformed, a pressure is applied to a liquid in the pressure chamber. In this case, in addition to these effects, another effect is further obtained such that in the producing process, a step of forming electrodes (individual electrodes) corresponding to the respective pressure chambers, on the surface of the piezoelectric layer on the side opposite to the pressure chambers becomes unnecessary. Therefore an effect of simplifying the producing process is also achieved.

In the piezoelectric actuator of the present invention, individual electrodes corresponding to the pressure chambers respectively may be provided between the insulating layer and the surface of the piezoelectric layer on the side opposite to the pressure chambers; at least a portion of each of the wirings may face an individual electrode corresponding thereto and included in the individual electrodes; the first through hole may be formed at an area of the insulating layer, the area facing both one of the wirings and one of the individual electrodes; and each of the wirings may be connected to one of the individual electrodes by the electroconductive material filled in the first through hole. In this case, when the drive voltage is applied selectively to the individual electrodes, an electric field is generated in the piezoelectric layer between the individual electrodes and the common electrode to deform the piezoelectric layer. As the piezoelectric layer is deformed, a volume of a pressure chamber corresponding to the individual electrode to which the drive voltage is supplied is changed, thereby applying pressure to the liquid in the pressure chamber.

Here, the insulating layer is formed entirely on the surface of the piezoelectric layer and the surface of the individual electrodes (surface on the side opposite to the pressure chambers), and a plurality of wirings are formed on the surface of the insulating layer. Further, each of the individual electrodes and the corresponding wiring are connected by the electroconductive material in one of the through holes formed in the insulating layer. Therefore, since the drive unit supplying the drive voltage and the individual electrodes are connected via the plurality of wirings formed on the flat surface of the insulating layer, the structure of electric connections between the drive unit and the individual electrodes becomes simple, and furthermore, it is possible to omit the wiring member such as the FPC. Moreover, the reliability of the electric connection becomes higher as compared to a case in which the drive unit and the individual electrodes are connected via a wiring member such as the FPC arranged flatly on the surface of the plurality of individual electrodes.

Furthermore, since the insulating layer is interposed between the piezoelectric layer and the wirings connected to the individual electrodes respectively, it is possible to suppress the generation of excessive electrostatic capacitance (parasitic capacitance) in portions of the piezoelectric layer between the wirings and the common electrode. Therefore, it is possible to improve the drive efficiency of the piezoelectric actuator, and to reduce the cost of the drive unit. Furthermore, it is possible prevent degradation of polarization characteristics of the piezoelectric layer which would be otherwise caused due to the excessive electrostatic capacitance. Moreover, since the piezoelectric layer generally has a low toughness, the piezoelectric layer is easily damaged when an external force or an impact acts during the producing process. In the present invention, however, the piezoelectric layer is covered with and protected by the insulating layer, and thus the external force or impact acted on the piezoelectric layer is absorbed by the insulating layer. Therefore, during the producing process, the piezoelectric layer is hardly damaged and the yield of the producing process is improved. The present invention includes not only an aspect that the vibration plate and the common electrode are structured as separate members, but also an aspect that the vibration plate is electroconductive and a surface of the vibration plate on a side opposite to the pressure chambers also serves as a common electrode.

In the piezoelectric actuator of the present invention, each of the wirings may have a terminal portion facing a pressure chamber corresponding thereto and included in the pressure chambers; the terminal portion may be formed to be greater in width or broader than other portion of each of the wirings; and the first through hole may be formed as a plurality of through holes at an area of the insulating layer, the area facing the broader terminal portion of one of the wirings. Thus, when the terminal portion of each of the wirings is formed to be broader, and each of the first holes is formed as a plurality of through holes at the area facing the broader terminal portion of one of the wirings, it is possible to apply the voltage assuredly to a desired area of the piezoelectric layer facing each of the pressure chambers with the electroconductive material which is filled in the first through hole formed as a plurality of through holes.

In the piezoelectric actuator of the present invention, a second through hole may be formed at an area of the insulating layer, the area facing the pressure chambers and facing none of the wirings. The insulating layer which protects the piezoelectric layer acts to obstruct the deformation of the piezoelectric layer when the piezoelectric layer is deformed. However, in the present invention, in addition to the first through hole, the second through hole not facing the wirings is formed, and the insulating layer is easily deformed due to the presence of the second through hole. Accordingly, the deformation of the piezoelectric layer is hardly obstructed by the insulating layer.

In the piezoelectric actuator of the present invention, a coefficient of elasticity of the electroconductive material may be smaller than a coefficient of elasticity of the insulating layer. In this case, the electroconductive material filled in the first through hole is more easily deformed than the insulating layer. In other words, since the insulating layer is easily deformed due to the plurality of through holes formed therein, and the electroconductive material is filled in the through holes, the deformation of the piezoelectric layer is hardly obstructed by the insulating layer.

In the piezoelectric actuator of the present invention, a drive unit connected to the plurality of wirings may be arranged on the surface of the insulating layer on the side opposite to the pressure chambers. In this case, the electroconductive material and the individual electrodes used in the present invention, which are in contact with the piezoelectric layer applied with the voltage, and the drive unit are connected only by the plurality of wirings. Accordingly, a wiring member such as an FPC is not necessary, and it is advantageous from a point of manufacturing cost.

In the piezoelectric actuator of the present invention, the drive unit and the common electrode may be connected via a conducting portion straddling or spreading over the piezoelectric layer and the insulating layer, and extending in a direction in which the piezoelectric layer and the insulating layer are stacked. Therefore, in addition that the plurality of wirings for applying the voltage to the piezoelectric layer are formed on the flat surface of the insulating layer, the conducting portion, which connects the drive unit and the common electrode, is also drawn up to the surface of the insulating layer, and the wirings and the drive unit, and the conducting portion and the drive unit are connected on the surface of the insulating layer. Therefore, the structure of the electric connection for applying the voltage from the drive unit to the piezoelectric layer becomes simple as compared to the case in which the connection is made via a wiring member such as the FPC, and the reliability of the connections is also improved.

According to a second aspect of the present invention, there is provided a liquid transporting apparatus including: a channel unit in which a liquid channel including a plurality of pressure chambers arranged along a plane is formed; and a piezoelectric actuator which is provided on one surface of the channel unit, and which selectively changes volume of the pressure chambers;

wherein the piezoelectric actuator includes: a vibration plate which covers the pressure chambers; a common electrode which is formed on a surface of the vibration plate on a side opposite to the pressure chambers; a piezoelectric layer which is arranged on a surface of the common electrode on a side opposite to the pressure chambers, so that the piezoelectric layer wholly covers the pressure chambers thereover; an insulating layer which is formed entirely on a surface of the piezoelectric layer on a side opposite to the pressure chambers; and wirings which are formed on a surface of the insulating layer on a side opposite to the pressure chambers, the wirings corresponding to the pressure chambers respectively; wherein a first through hole is formed at an area of the insulating layer, the area facing one of the wirings; and the first through hole is filled with an electroconductive material connected to one of the wirings.

According to the liquid transporting apparatus of the present invention, when the electroconductive material reaching up to the surface of the piezoelectric layer, for example, is included, the structure of the electric connection for supplying the drive voltage to the electroconductive material becomes simple, and the reliability of the electric connection is improved. Alternatively, when the individual electrodes are included, for example, the structure of the electric connection for supplying the drive voltage to the individual electrodes becomes simple, and the reliability of the electric connection is improved. Moreover, it is possible to suppress the generation of excessive electrostatic capacitance in the piezoelectric layer at its portions sandwiched between the wirings and the common electrode. Furthermore, since the piezoelectric layer is protected by the insulating layer, the piezoelectric layer is hardly damaged during the manufacturing process. In addition to this, when no individual electrodes are formed, the step of forming electrodes corresponding to the respective pressure chambers, on the surface of the piezoelectric layer on the side opposite to the pressure chambers becomes unnecessary. Therefore, the effect of simplifying the manufacturing process is also achieved. The present invention includes the aspect that the vibration plate is electroconductive and the surface of the vibration plate on the side opposite to the pressure chambers also serves as the common electrode.

According to a third aspect of the present invention, there is provided a method of producing the piezoelectric actuator, the method including: an insulating layer forming step of forming the insulating layer entirely on the surface of the piezoelectric layer on the side opposite to the vibration plate; a through hole forming step of forming a first through hole at an area of the insulating layer, the area facing one of the pressure chambers; a filling step of filling the electroconductive material in the first through hole such that the electroconductive material is reached up to the piezoelectric layer; and a wiring forming step of forming the wirings each of which is to be connected to the electroconductive material, on the surface of the piezoelectric layer on the side opposite to the vibration plate. According to the method of producing the piezoelectric actuator, it is possible to achieve the piezoelectric actuator of the present invention which shows various effects.

In the method of producing the piezoelectric actuator of the present invention, the filling step and the wiring forming step may be performed simultaneously. According to the method of producing the piezoelectric actuator, since it is possible to form the wirings while filling the electroconductive material in the first through hole, it is possible to simplify the producing process.

BRIEF DESCRIPTION OF THE DRAWINGS

FIG. 8 (FIGS. 8A to 8F) is diagram showing a producing process of the piezoelectric actuator of the first embodiment, wherein

FIG. 14 (FIGS. 14A to 14E) is a diagram showing a producing process of a piezoelectric actuator of the second embodiment, wherein

DETAILED DESCRIPTION OF THE PREFERRED EMBODIMENTS

Figure 1:
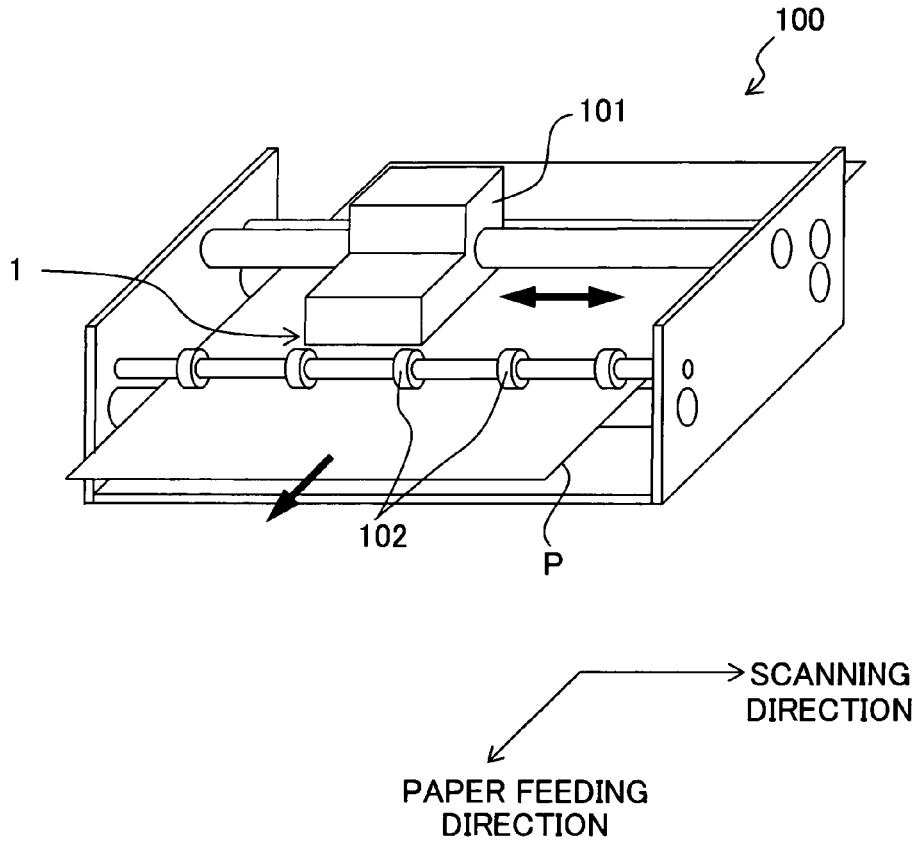
FIG. 1 is a schematic structural diagram of an ink-jet head according to the first embodiment of the present invention.

A first embodiment of the present invention will be explained below. This first embodiment is an example in which the present invention is applied to an ink-jet head, as a liquid transporting apparatus, which discharges ink onto a recording paper from its nozzles. Firstly, an ink-jet printer 100 which includes an ink-jet head 1 will be briefly explained below. As shown in FIG. 1, the ink-jet printer 100 includes a carriage 101 which is movable in a left and right direction in FIG. 1 (direction indicated by a two-way arrow), the ink-jet head 1 of serial type which is provided on the carriage 101 and which discharges ink on to a recording paper P, and transporting rollers 102 which feed the recording paper P in a forward direction in FIG. 1 (direction indicated by an one-way arrow) The ink-jet head 1 moves integrally with the carriage 101 in the left and right direction (scanning direction) and jets ink onto the recording paper P from ejecting ports of nozzles 20 (see FIG. 4) formed in an ink-discharge surface of a lower surface of the ink-jet head 1. The recording paper P, with an image and/or letter recorded thereon by the ink-jet head 1, is discharged forward (paper feeding direction) by the transporting rollers 102.

Next, the ink-jet head 1 will be explained in detail with reference to FIG. 2 to FIG. 7. As shown in FIG. 2 to FIG. 5, the ink-jet head includes a channel unit 2 in which a plurality of individual ink channels 21 each including a pressure chamber 14 formed therein, and a piezoelectric actuator 3 which is arranged on an upper surface of the channel unit 2.

Figure 4:
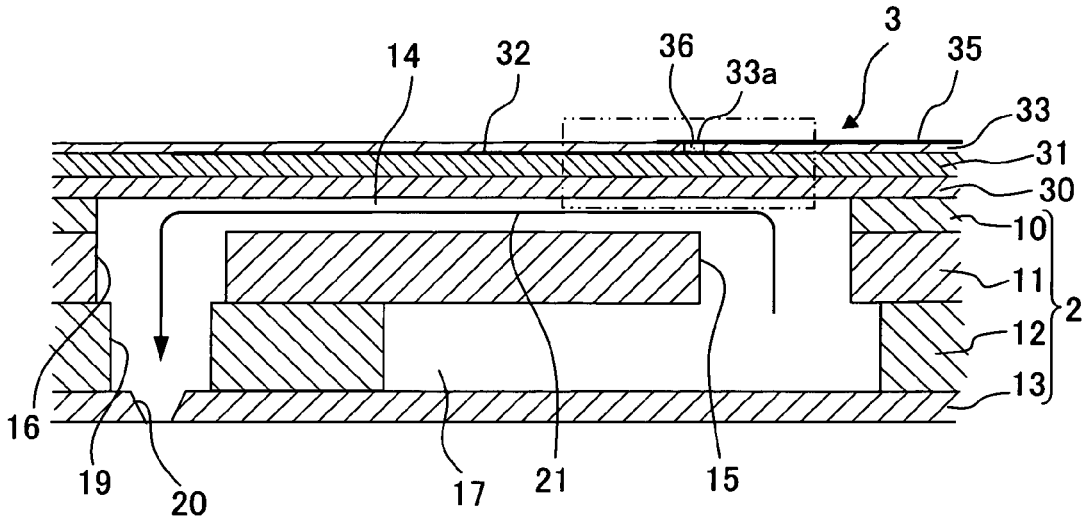
FIG. 4 is a cross-sectional view taken along a line IV-IV in FIG. 3.
Figure 6:
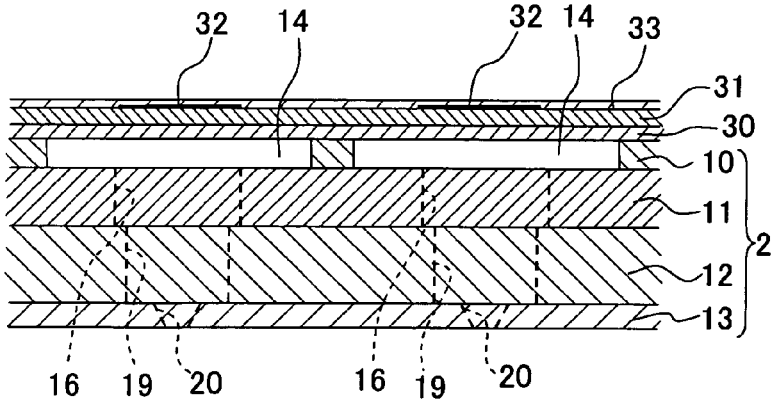
FIG. 6 is a cross-sectional view taken along a line VI-VI in FIG. 3.

The channel unit 2 will be explained below. As shown in FIG. 4 and FIG. 6, the channel unit 2 includes a cavity plate 10, a base plate 11, a manifold plate 12, and a nozzle plate 13, and these four plates 10 to 13 are joined in stacked as laminated layers. Among these four plates, the cavity plate 10, the base plate 11, and the manifold plate 12 are stainless steel plates, and an ink channel such as the pressure chamber 14, and a manifold 17 which will be explained later, can be formed easily in these plates by etching. Moreover, the nozzle plate 13 is formed of a high molecular synthetic resin material such as polyimide, and is joined to the lower surface of the manifold plate 12. Alternatively, the nozzle plate 13 may also be formed of a metallic material such as stainless steel, similar to the three plates 10 to 12.

As shown in FIGS. 2 to 4 and 6, in the cavity plate 10, a plurality of pressure chambers 14 arranged in a row along a plane is formed. These pressure chambers 14 are open towards a side of a vibration plate 30 (upper side in FIGS. 4 and 6). Moreover, the pressure chambers 14 are arranged in two rows in the paper feeding direction (vertical direction in FIG. 2). Each of the pressure chambers 14 is formed to be substantially elliptical which is long in the scanning direction (left and right direction) in a plan view.

Figure 2:
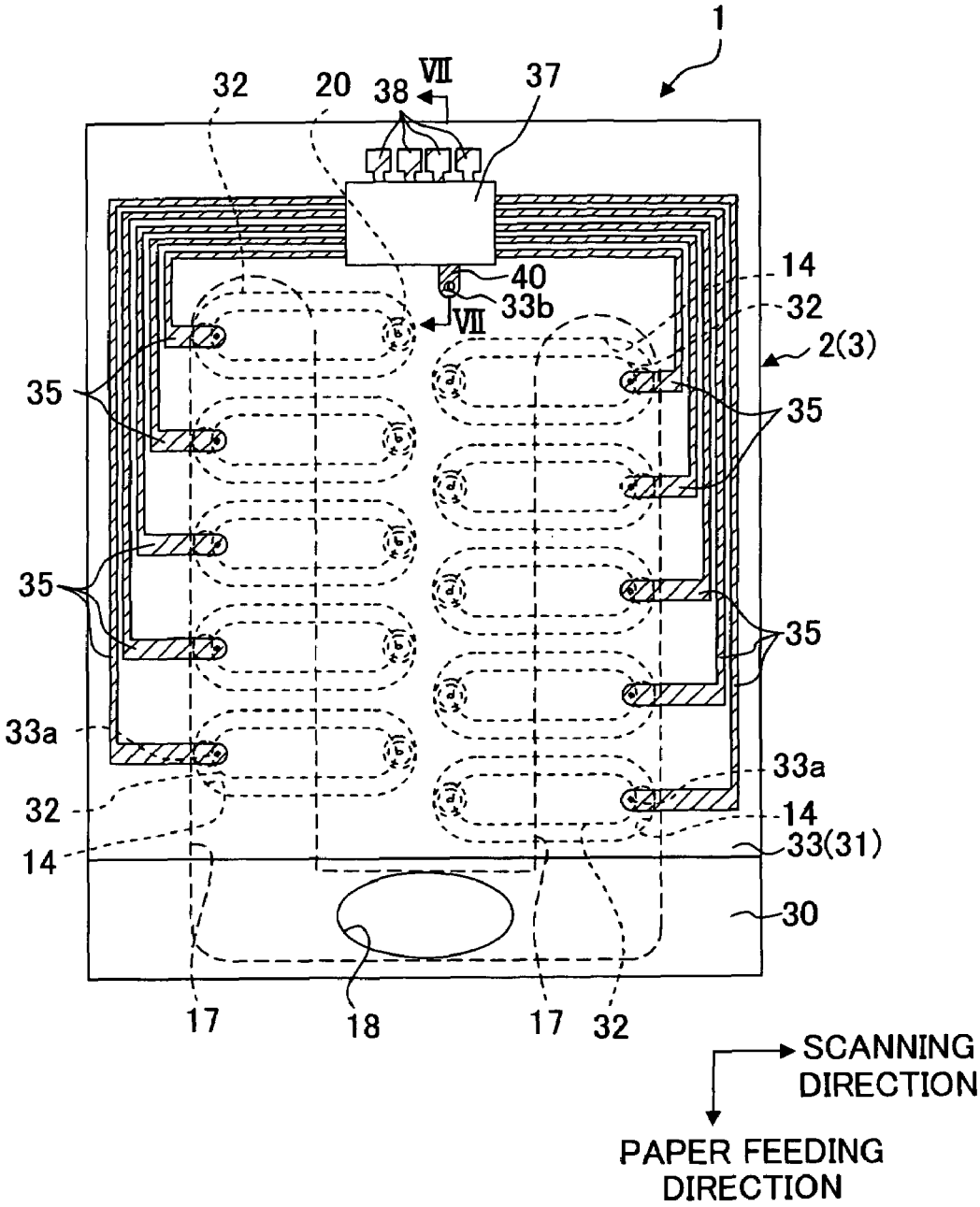
FIG. 2 is a plan view of the ink-jet head.
Figure 3:
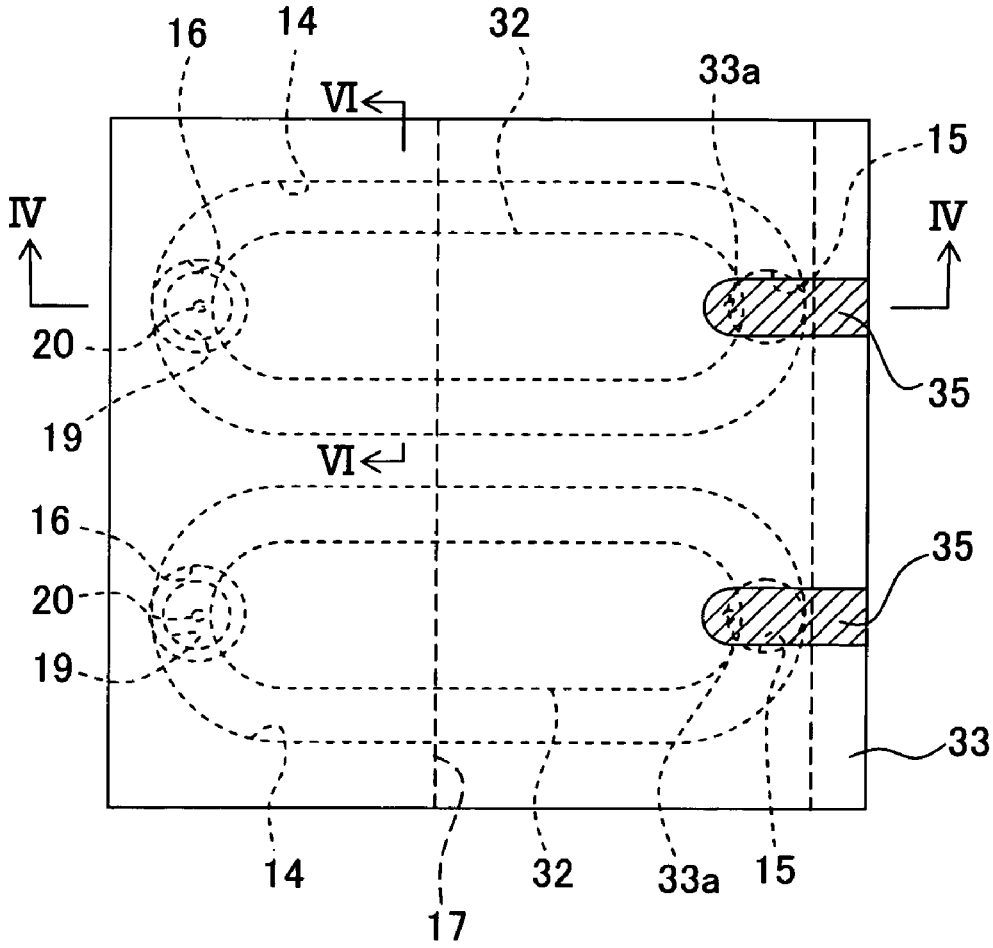
FIG. 3 is a partially enlarged view of FIG. 2.

As shown in FIGS. 3 and 4, communication holes 15 and 16 are formed in the base plate 11 at positions which overlap in a plane view with both end portions in the long axis direction respectively of one of the pressure chambers 14. Moreover, in the manifold plate 12, a manifold 17 which is extended in the paper feeding direction (vertical direction in FIG. 2) is formed. As shown in FIG. 2 and FIG. 4, the manifold 17 is formed such that the manifold 17 overlaps, in a plan view, with left halves of the pressure chambers 14 arranged on the left side and right halves of the pressure chambers 14 arranged on the right side. Further, an ink supply port 18 formed in the vibration plate 30 which will be explained later is connected to the manifold 17, and ink is supplied to the manifold 17 from an ink tank (not shown in the diagram) via the ink supply port 18. Moreover, a plurality of communication holes 19 communicating with a plurality of communication holes 16 respectively are formed in the manifold plate 12 at positions each of which overlaps in a plane view with an end portion of one of the pressure chambers 14, the end portion being on a side opposite to the manifold 17. Furthermore, a plurality of nozzles 20 is formed in the nozzle plate 13 at positions each of which overlaps in a plan view with one of the communication holes 19. The nozzles 20 are formed by performing an excimer laser process on a substrate of a high molecular synthetic resin such as polyimide.

As shown in FIG. 4, the manifold 17 communicates with the pressure chamber 14 via the communication hole 15, and the pressure chamber 14 communicates with the nozzle 20 via the communication holes 16 and 19. Thus, the individual ink channels 21 each from the manifold 17 to one of the nozzles 20 via one of the pressure chambers 14 are formed in the channel unit 2.

Next, the piezoelectric actuator 3 will be explained below. As shown in FIGS. 2 to 6, the piezoelectric actuator 3 includes a vibration plate 30, a piezoelectric layer 31, and a plurality of individual electrodes 32. The vibration plate 30 is arranged on the upper surface of the channel unit 2. The piezoelectric layer 31 is formed on the upper surface of the vibration plate 30 (surface on a side opposite to the pressure chambers 14). The individual electrodes 32 are formed on the upper surface of the piezoelectric layer 31 corresponding to the pressure chambers 14 respectively.

The vibration plate 30 is a plate having substantially a rectangular shape in a plan view and is made of a metallic material such as an iron alloy like stainless steel, a copper alloy, a nickel alloy, or a titanium alloy. The vibration plate 30 is arranged on the upper surface of the cavity plate so as to cover the plurality of pressure chambers 14, and is joined to the upper surface of the cavity plate 10. Moreover, the vibration plate 30 formed of a metallic material is electroconductive, and also serves as a common electrode which generates an electric field in the piezoelectric layer 31 sandwiched between the vibration plate 30 and the individual electrodes 32.

The piezoelectric layer which is mainly composed of lead zirconate titanate (PZT) that is a solid solution of lead titanate and lead zirconate, and is a ferroelectric substance, is formed on the upper surface of the vibration plate 30. As shown in FIGS. 2 to 6, the piezoelectric layer 31 is continuously formed on the upper surface of the vibration plate 30, so that the piezoelectric layer 31 wholly covers the pressure chambers 14 thereover.

The plurality of individual electrodes 32 which are elliptic, flat, and smaller in size to some extent than the pressure chamber 14 is formed on the upper surface of the piezoelectric layer 31. The individual electrodes 32 are formed at positions overlapping in a plan view with the central portions of the corresponding pressure chambers 14 respectively. The individual electrodes 32 are made of an electroconductive material such as gold, copper, silver, palladium, platinum, or titanium.

As shown in FIGS. 2 to 6, an insulating layer 33 is formed entirely on the upper surfaces of the individual electrodes 32 and the piezoelectric layer 31. The insulating layer 33 is made of an insulating material exemplified by a ceramics material such as alumina and zirconia or a synthetic resin material such as polyimide. A dielectric constant of the insulating layer 33 is sufficiently lower than a dielectric constant of the piezoelectric layer 31.

Figure 5:
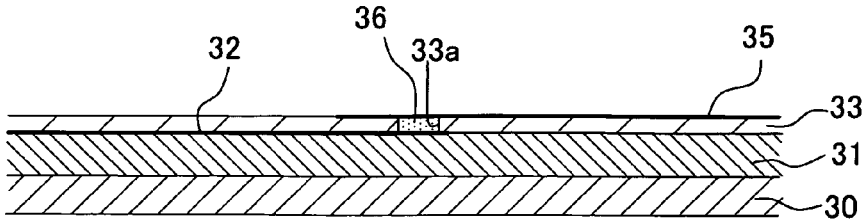
FIG. 5 is an enlarged view of a portion surrounded by alternate long and short dash lines in FIG. 4.

A plurality of wirings 35 are formed on the upper surface of the insulating layer 33, each of the wirings extending from an area which faces an end portion (end portion on the left or right side in the width direction of the ink-jet head 1) of one of the individual electrodes 32, the end portion being on a side in which one of the communication holes 15 is located. Moreover, through holes 33*a* are formed in the insulating layer 33 at areas each of which faces both of the end portion of one of the individual electrodes 32 and an end portion of one of the wirings 35. Furthermore, as shown in FIGS. 4 and 5, an electroconductive material 36 is filled in the through hole 33*a*. The individual electrode 32 positioned on a lower side of the insulating layer 33 and the wiring 35 positioned on an upper side of the insulating layer are brought into conduction by the electroconductive material 36.

As shown in FIG. 2, a driver IC 37 is arranged in the insulating layer 33 at an area on the upper side of an area facing the pressure chambers 14 (upstream side of paper feeding direction). The wirings 35 connected to the individual electrodes 32 via the electroconductive material 36 are extended respectively to the upper side in FIG. 2, and are connected to the driver IC 37 on the flat upper surface of the insulating layer 33. A plurality of terminals (four terminals, for example) 38 connected to the driver IC 37 are formed on the upper surface of the insulating layer 33. The driver IC 37 and a control unit (not shown in the diagram) of the ink-jet printer 100 which controls the driver IC are connected via the terminals 38. Based on a command from the control unit, a drive voltage is supplied from the driver IC 37 to each of the individual electrodes 32 via the electroconductive material 36 in one of the through holes 33*a* and one of the wirings on the surface of the insulating layer 33.

Figure 7:
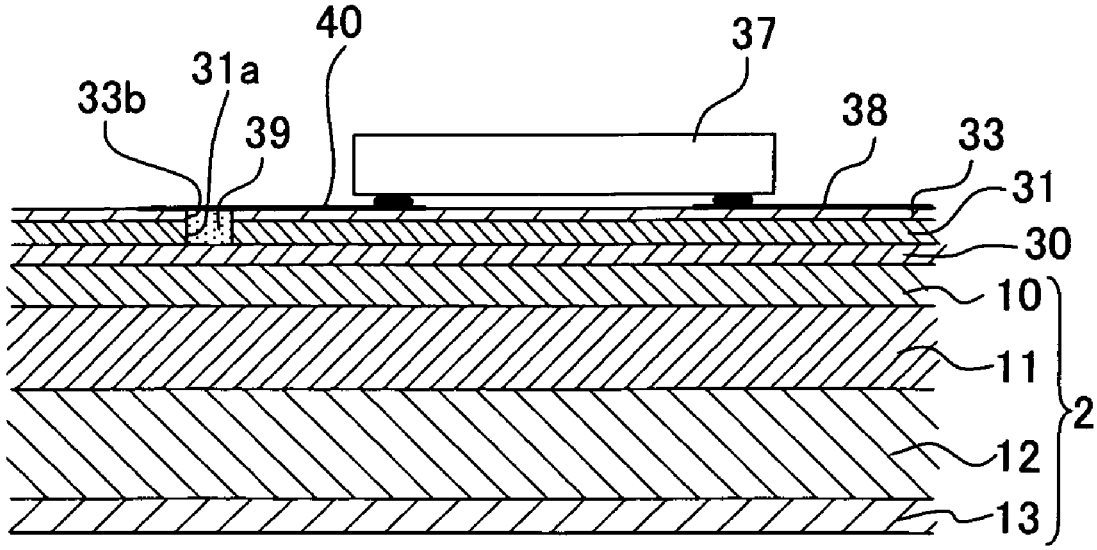
FIG. 7 is a cross-sectional view taken along a line VII-VII in FIG. 2.

Further, as shown in FIGS. 2 and 7, a through hole 33*b* is formed in the insulating layer 33 at a position in the vicinity of the driver IC 37, and a through hole 31*a* communicating with the through hole 33*b* is formed in the piezoelectric layer 31 at a position below the through hole 33*b*. An electroconductive material 39 (conducting portion) is filled in these two through holes 33*b* and 31*a*. The electroconductive material 39 spreads or straddles over the piezoelectric layer 31 and the insulating layer 33, from the upper surface of the insulating layer 33, extending in a direction in which the piezoelectric layer 31 and the insulating layer 33 are stacked, and reaching up to the upper surface of the vibration plate 30 as the common electrode. Furthermore, the electroconductive material 39 is connected to the driver IC 37 via a wiring 40 formed on the upper surface of the insulating layer 33. Therefore, since the vibration plate 30 is connected to the driver IC 37 via the electroconductive material 39 and the wiring 40, an electric potential of the vibration plate 30 is always kept at a ground potential via the driver IC 37.

Next, an ink-discharge action of the piezoelectric actuator 3 will be explained. When a drive voltage is selectively applied from the driver IC 37 to the individual electrodes 32, the electric potential of the individual electrode 32 on the upper side of the piezoelectric layer 31 to which the drive voltage is supplied differs from the electric potential of the vibration plate 30 which serves as the common electrode, which is disposed on a lower side of the piezoelectric layer 31 and which is kept at a ground potential, and an electric field in a vertical direction is generated in a portion of the piezoelectric layer 31 which is sandwiched between the individual electrode 32 and the vibration plate 30. As the electric field is generated, the piezoelectric layer 31 is contracted in a horizontal direction which is orthogonal to a vertical direction in which the piezoelectric layer 31 is polarized. As the piezoelectric layer 31 is contracted, since the vibration plate 30 is deformed due to the contraction of the piezoelectric layer 31 so as to project toward the pressure chamber 14, the volume inside the pressure chamber 14 is decreased to apply pressure to the ink in the pressure chamber 14, thereby discharging the ink from the nozzle 20 communicating with the pressure chamber 14.

In this case, as described above, the insulating layer 33 is formed on the entire upper surface of the individual electrodes 32 and the piezoelectric layer 31, and the wirings 35 corresponding to the individual electrodes 32 respectively and the wiring 40 corresponding to the vibration plate 30 which also serves as the common electrode are formed on the upper surface of the insulating layer 33 (see FIG. 2). Further, as shown in FIGS. 4 and 7, each of the individual electrodes 32 and each of the wirings 35 are connected by the electroconductive material 36 in the through hole 33*a* formed in the insulating layer 33, and the vibration plate 30 and the wiring 40 are also connected by the electroconductive material 39 in the through holes 33*b* and 31*a* formed in the insulating layer 33 and the piezoelectric layer 31, respectively. Furthermore, the driver IC 37 is also arranged on the upper surface of the insulating layer 33 and is connected to the wirings 35 and 40. Therefore, it is possible to connect the individual electrodes 32 and the driver IC via the wirings 35 respectively and to connect the driver IC and the vibration plate 30 also serving as the common electrode via the wiring 40, both of the wirings 35 and 40 being formed on the flat upper surface of the insulating layer 33, instead of using a wiring member such as an FPC in which fine-wiring pattern is formed. Therefore, it is possible to simplify the structure of the electric connection of the wirings 35 and 40, and it is advantageous in view of the producing cost. Moreover, the reliability of electric connection is improved as compared to the reliability in a case in which the driver IC 37, the individual electrodes 32, and the vibration plate 30 are connected via the wiring member such as the FPC arranged flatly on the surfaces of the individual electrodes 32 (see, for example, U.S. Patent Application Publication No. US2004/119790 A1 as mentioned earlier).

Moreover, the insulating layer 33 having a dielectric constant lower than the dielectric constant of the piezoelectric layer 31 is interposed between the wirings 35 and the piezoelectric layer 31. Due to the insulating layer 33, the generation of excessive electrostatic capacitance is suppressed in a portion of the piezoelectric layer which is between the vibration plate 30 and the wiring 35 and to which the drive voltage is applied. Therefore, a loss due to an electrical discharge is suppressed, and it is thus possible to improve the driving efficiency of the piezoelectric actuator 3 and to reduce the cost of the driver IC 37. Furthermore, it possible to prevent, to the maximum extent, the degradation of polarization characteristics of the piezoelectric layer 31 caused due to the excessive electrostatic capacitance.

Moreover, the toughness of the piezoelectric layer 31, formed of a piezoelectric ceramics material such as PZT, is generally low. Accordingly, when an external force or an impact acts on the piezoelectric layer 31 during the producing process of the ink-jet head 1, the piezoelectric layer is susceptible to damage such as a crack and breaking. However, in the piezoelectric actuator 3 of the first embodiment, since the piezoelectric layer 31 is covered and protected by the insulating layer 33, the external force or impact acting on the piezoelectric layer 31 is absorbed by the insulating layer 33, the piezoelectric layer 31 is hardly damaged, and the yield of the producing process is improved.

Figure 8A:
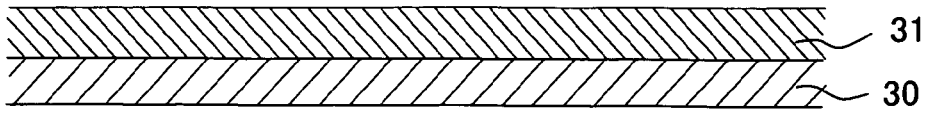
FIG. 8A shows a piezoelectric layer forming step in the producing process.

Next, a method of producing the piezoelectric actuator 3 will be explained by referring to FIG. 8. Firstly, as shown in FIG. 8A, the piezoelectric layer 31 is formed on one surface of the vibration plate 30. Here, the piezoelectric layer 31 can be formed by using an aerosol deposition method (AD method) in which very fine particles of a piezoelectric material are blown onto a substrate to be collided on the substrate at a high velocity and are deposited on the substrate. Alternatively, it is possible to form the piezoelectric layer 31 by a method such as a sputtering method, a chemical vapor deposition (CVD) method, a sol-gel method, a solution coating method, or a hydrothermal synthesis method. Moreover, it is also possible to form the piezoelectric layer 31 by sticking on the vibration plate 30 a piezoelectric sheet made by baking a green sheet of PZT.

Figure 8B:
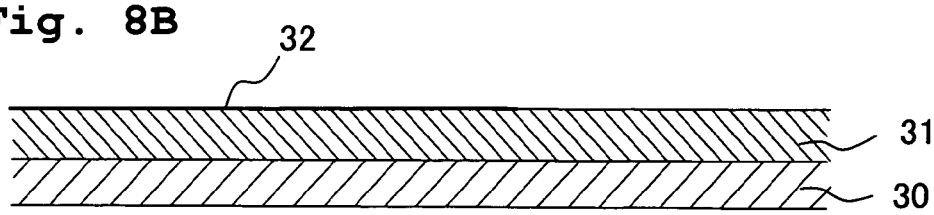
FIG. 8B shows an individual electrode forming step in the producing process.
Figure 8C:
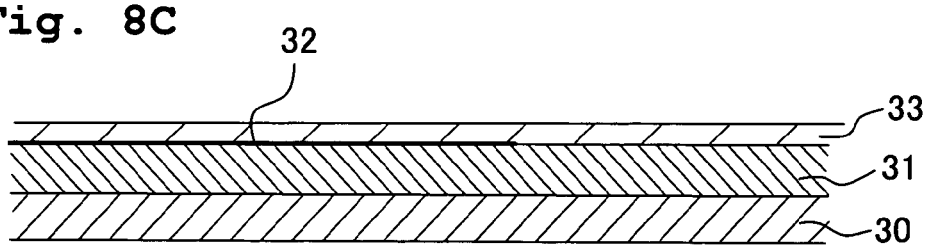
FIG. 8C shows an insulating layer forming step in the producing process.

As shown in FIG. 8B, the individual electrodes 32 are formed on the upper surface of the piezoelectric layer 31 by a method such as screen printing. Further, as shown in FIG. 8C, the insulating layer 33 is formed entirely on the upper surfaces of the individual electrodes 32 and the piezoelectric layer 31. Here, when the insulating layer 33 is to be formed of a ceramics material such as alumina and zirconia, it is possible to use the AD method, the sputtering method, the CVD method, the sol-gel method, the solution coating method, or the hydrothermal synthesis method. Moreover, when the insulating layer 33 is to be formed of a synthetic resin material such as polyimide, it is possible to use a method such as the screen printing, a spin coating, or a blade coating.

Figure 8D:
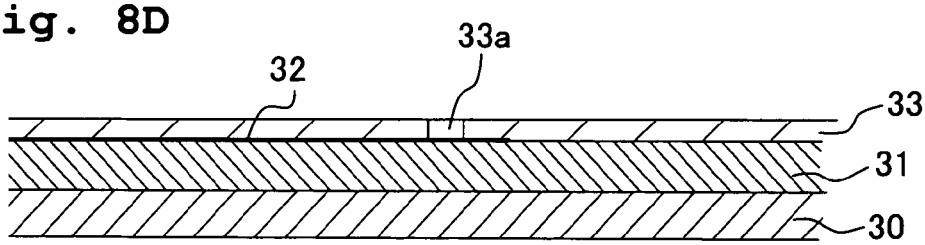
FIG. 8D shows a through hole forming step in the producing process.
Figure 8E:
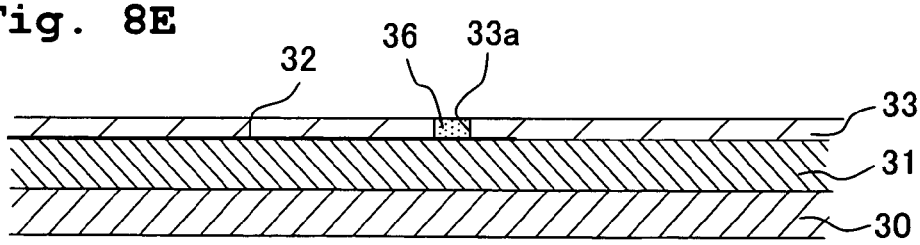
FIG. 8E shows a filling step of filling an electroconductive material in the producing process.
Figure 8F:
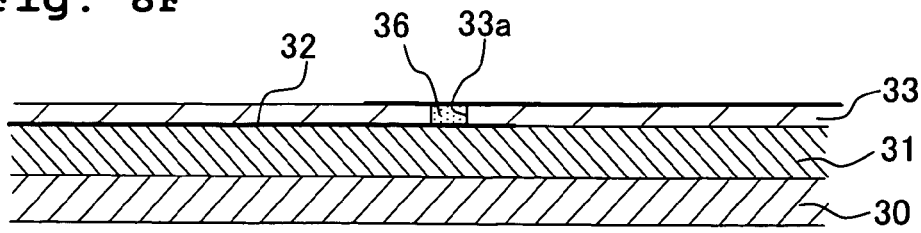
FIG. 8F shows a wiring forming step in the producing process.

Next, as shown in FIG. 8D, the through holes 33*a* for the individual electrodes 32 are formed in the insulating layer 33 by a laser processing or the like. Although not shown in FIG. 8, at the time of forming the through holes 33*a*, the through hole 33*b* for the vibration plate 30 (common electrode) and the through hole 31*a* (see FIG. 7) of the piezoelectric layer 31 communicating with the through hole 33*b* are formed simultaneously. When the through holes 33*b* and 31*a* are formed, an output of a laser is increased or an irradiation time of the laser is elongated. Furthermore, as shown in FIG. 8E, by a liquid-droplet discharge method or the screen printing method, the electroconductive material 36 is filled in the through hole 33*a* and the electroconductive material 39 is filed in the through holes 33*b* and 31*a* (see FIG. 7). Next, as shown in FIG. 8F, the wirings 35 to be connected to the individual electrodes 32 and the wiring 40 to be connected to the vibration plate 30 (see FIG. 7) are formed on the upper surface of the insulating layer 33 by the screen printing or the like. At this time, since it is possible to form the plurality of wirings 35 corresponding to the plurality of individual electrodes 32 respectively, and the wiring 40 corresponding to the vibration plate 30 (common electrode) at a time, the forming of the wirings 35 and 40 is facilitated.

As shown in FIG. 8D, after forming the through holes 33*a* and 33*b* in the insulating layer 33, the wirings 35 and 40 may be formed, on the upper surface of the insulating layer 33, of a material same as the electroconductive materials 36 and 39, while filling the electroconductive materials 36 and 39 in the through holes 33*a* and 33*b*, respectively, by the screen printing method or the like. In this case, since it is possible to simultaneously perform the filling of the electroconductive materials 36 and 39 and the formation of the wirings 35 and 40, it is possible to simplify the producing process, and it is advantageous in terms of producing cost.

Next, a modified embodiment in which various modifications are made in the first embodiment, will be explained. The same reference numerals will be used for parts of components having the same structure as those in the first embodiment, and the explanation therefor will be omitted as appropriate.

First Modified Embodiment

Figure 9:
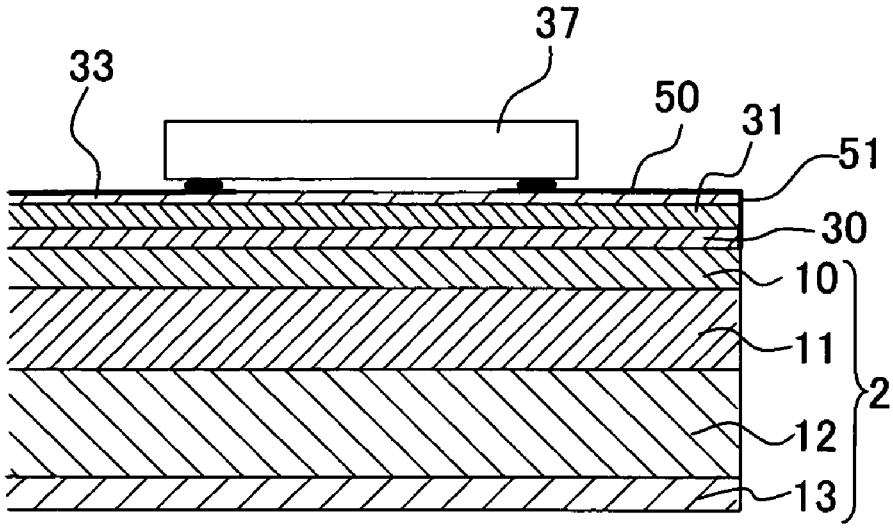
FIG. 9 is a cross-sectional view according to a modified embodiment of the first embodiment, corresponding to FIG. 7.

In the first embodiment, the vibration plate 30 serving as the common electrode and the wiring 40 connected to the driver IC 37 are connected by the electroconductive material 39 in the through holes 33*b* and 31*a* (see FIG. 7). As shown in FIG. 9, a wiring 51 (conducting portion) straddling or stretching over the insulating layer 33 and the piezoelectric layer 31, and extending in a direction in which the insulating layer 33 and the piezoelectric layer 31 are stacked may be formed on the side surface of the piezoelectric layer 31 and the side surface of the insulating layer 33, and the vibration plate 30 and the wiring 50 on the upper surface of the insulating layer 33 may be connected by the wiring 51. Moreover, the wiring 51 can be formed by coating an electroconductive paste on the side surfaces of the piezoelectric layer 31 and the insulating layer 33.

Second Modified Embodiment

It is not necessarily indispensable that the upper surface of the vibration plate 30 serves also as the common electrode, and a common electrode 34 may be provided separately from the vibration plate 30. When the vibration plate 30 is a metallic plate, however, the upper surface of the vibration plate 30 is required to be nonconductive by forming an insulating material layer on the surface of the vibration plate 30 on which the common electrode 34 is to be formed. When the vibration plate 30 is made of a silicon material, the upper surface of the vibration plate 30 may be made to be nonconductive by performing an oxidation treatment. Further, when the vibration plate 30 is made of a ceramics material or a synthetic resin material or the like, the common electrode 34 is formed directly on the upper surface of the vibration plate 30.

Figure 11:
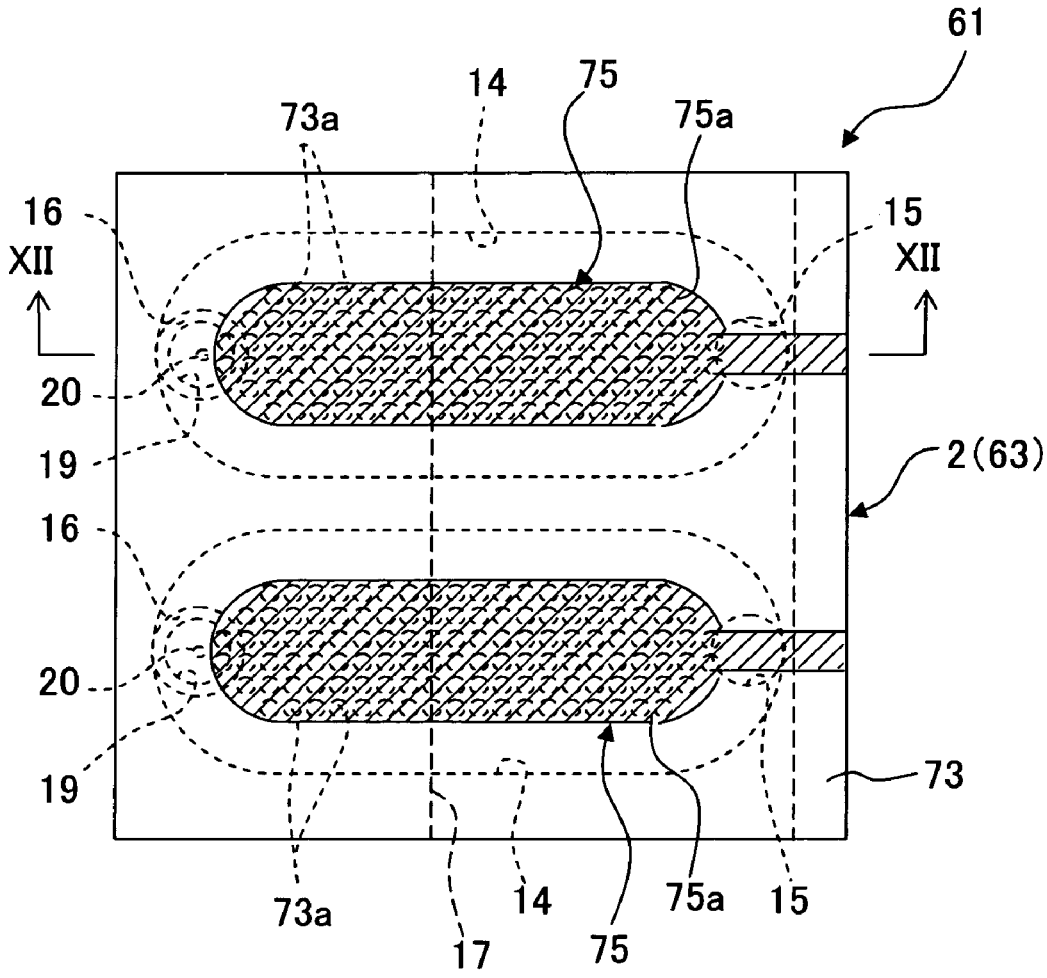
FIG. 11 is a partially enlarged plan view of an ink-jet head of a second embodiment.
Figure 12:
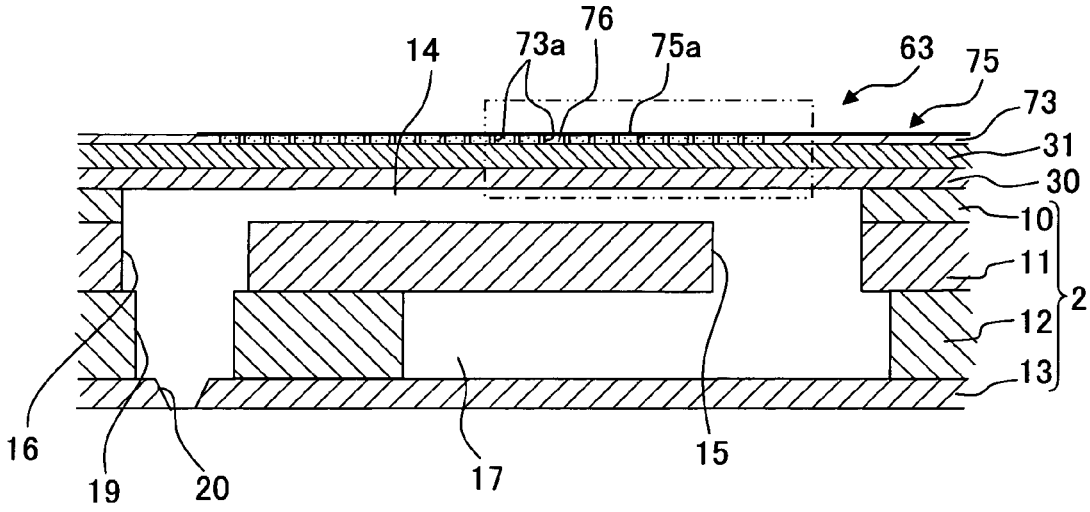
FIG. 12 is a cross-sectional view taken along a line XII-XII in FIG. 11.

Next, a second embodiment of the present invention will be explained. The same reference numerals will be used for the parts or components having the similar structure as those in the first embodiment, and the explanation therefor will be omitted as appropriate. As shown in FIGS. 11 and 12, an ink-jet head 61 of the second embodiment includes a channel unit 2 having a plurality of pressure chambers 14 formed therein, and a piezoelectric actuator 63 arranged on one surface of the channel unit 2. The channel unit 2 is same as that in the first embodiment, and the explanation of the channel unit 2 will be omitted.

Figure 13:
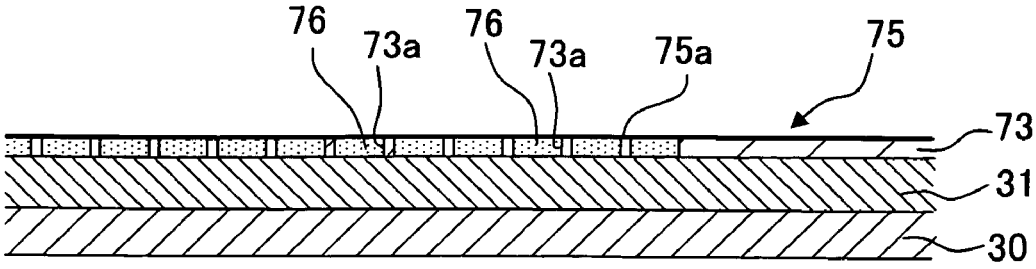
FIG. 13 is an enlarged view of a portion surrounded by alternate long and short dash lines in FIG. 12.

The piezoelectric actuator 63 differs from the piezoelectric actuator 3 of the first embodiment in that the individual electrodes 32 (see FIG. 4) facing the pressure chambers 14 respectively are omitted. As shown in FIGS. 11 to 13, this piezoelectric actuator 63 includes a metallic vibration plate 30 which covers the pressure chambers 14 and which serves also as the common electrode, and the piezoelectric layer 31 which is arranged continuously on the upper surface of the vibration plate 30 so that the piezoelectric layer 31 wholly covers the pressure chambers 14 thereover. The individual electrodes 32 in the first embodiment (see FIG. 4) are not formed on the upper surface of the piezoelectric layer 31. On the other hand, an insulating layer 73 made of an insulating material such as a ceramics material and a synthetic resin material is formed on the upper surface of the piezoelectric layer 31 similarly as in the first embodiment. Further, a plurality of wirings 75 each of which faces, at an end portion 75*a* thereof, one of the plurality of pressure chambers 14 are formed on an upper surface of the insulating layer 73. Here, as shown in FIG. 11, the end portion 75*a* of each of the wirings 75 has a substantially elliptical flat shape which is smaller in size to some extent than the pressure chamber 14, and is formed to be broader or greater in width than other portion of the wiring 75.

Further, a plurality of through holes 73*a* (first through holes) are formed in the insulating layer 73 at an area facing the end portion 75*a* of one of the wirings 75, the end portion 75*a* being broader than the other portion of the wiring 75 (at an area facing both one of the pressure chambers 14 and one of the wirings 75). Furthermore, an electroconductive material 76 which is connected to the wiring 75 is filled in each of the through holes 73*a* such that the electroconductive material 76 is reached up to the upper surface of the piezoelectric layer 31. In other words, the electroconductive material 76 (portions of electroconductive material 76) filled in the through holes 73*a* is in contact with the upper surface of the piezoelectric layer 31, and the electroconductive material 76 in these through holes 73*a* serves as one of the individual electrodes 32 of the first embodiment which apply the voltage to the piezoelectric layer 31. In other words, when the drive voltage is applied, via the wiring 75, to the portions of the electroconductive material 76 from the driver 37 (see FIG. 2) having a similar structure as that in the first embodiment, an electric field is generated in a portion of the piezoelectric layer between the portions of the electroconductive material 76 and the vibration plate 30 serving as the common electrode, and the piezoelectric layer 31 is deformed.

According to the piezoelectric actuator 63 of the second embodiment, similarly as the piezoelectric actuator 3 of the first embodiment, it is possible to connect the portions of the electroconductive material 76, which are in contact with the piezoelectric layer 31 in the through holes 73*a* respectively, and the driver IC 37 which supplies the drive voltage to these portions of the electroconductive material 76 with the wirings 75 formed on the flat surface of the insulating layer 73. Therefore, it is possible to omit the wiring member such as the FPC, and the reliability of electric connection is improved. Moreover, it is possible to suppress the generation of excessive electrostatic capacitance in the piezoelectric layer 31 sandwiched between the wirings 75 and the vibration plate 30 serving as the common electrode. Furthermore, since the piezoelectric layer 31 is protected by the insulating layer 73, the piezoelectric layer 31 is hardly damaged during the producing process.

Moreover, the end portion 75*a* of each of the wirings 75 on the upper surface of the insulating layer, the end portion 75*a* facing one of the pressure chambers 14, is formed to be broad, and further the plurality of through holes 73*a* are formed at the area facing the broad end portion 75*a*. Therefore, by the electroconductive material 76 filled in each of the through holes 73*a*, it is possible to apply the voltage assuredly to a desired area of the piezoelectric layer 31 facing each of the pressure chambers 14.

Moreover, the insulating layer 73 which protects the piezoelectric layer 31 acts to obstruct or hinder the deformation of the piezoelectric layer 31 when the piezoelectric layer 31 is deformed. Therefore, due to the insulating layer 73 provided on the upper surface of the piezoelectric layer 31, the drive efficiency of the piezoelectric actuator 63 is somewhat decreased. In the second embodiment, however, the plurality of through holes 73*a* is formed in the insulating layer 73, and further, a coefficient of elasticity of the electroconductive material 76 filled in these through holes 73*a* (for example, epoxy-based electroconductive adhesive: 4 GPa) is smaller than the coefficient of elasticity of the insulating layer 73 (for example, alumina: 300 GPa, polyimide: 6 GPa). In other words, the electroconductive material 76 filled in the through holes 73*a* is more easily to be deformed than the insulating layer 73. Therefore, by forming the plurality of through holes 73*a* in the insulating layer 73 and by filling the electroconductive material 76 in the through holes 73*a*, the insulating layer 73 is more easily to be deformed than in a case in which neither through holes 73*a* nor electroconductive material 76 are provided. Therefore, the deformation of the piezoelectric layer 31 is hardly obstructed by the insulating layer 73.

Figure 14A:
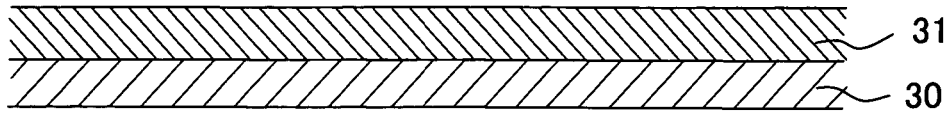
FIG. 14A is a diagram showing a piezoelectric layer forming step in the producing process.

Next, a method of producing the piezoelectric actuator 63 will be explained by referring to FIG. 14. Firstly, as shown in FIG. 14A, the piezoelectric layer 31 is formed on one surface of the vibration plate 30. In this case, the piezoelectric layer 31 can be formed by the AD method, the sputtering method, the chemical vapor deposition (CVD) method, the sol-gel method, the solution coating method, or the hydrothermal synthesis method or the like. Alternatively, it is also possible to form the piezoelectric layer 31 by sticking on the vibration plate 30 the piezoelectric sheet made by baking a green sheet of PZT.

Figure 14B:
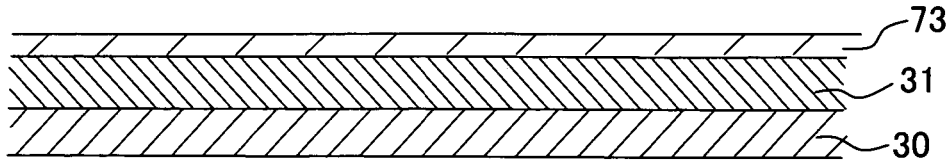
FIG. 14B is a diagram showing an insulating layer forming step in the producing process.

Next, as shown in FIG. 14B, the insulating layer 73 is formed on the entire upper surface of the piezoelectric layer 31 (insulating layer forming step). In this case, when the insulating layer 73 is to be formed of a ceramics material such as alumina and zirconia, the insulating layer 73 can be formed by using a method such as the AD method, the sputtering method, the CVD method, the sol-gel method, the solution coating method, or the hydrothermal synthesis method. Moreover, when the insulating layer 73 is to be formed by a synthetic resin material such as polyimide, the insulating layer 73 can be formed by a method such as the screen printing, the spin coating, and the blade coating.

Figure 14C:
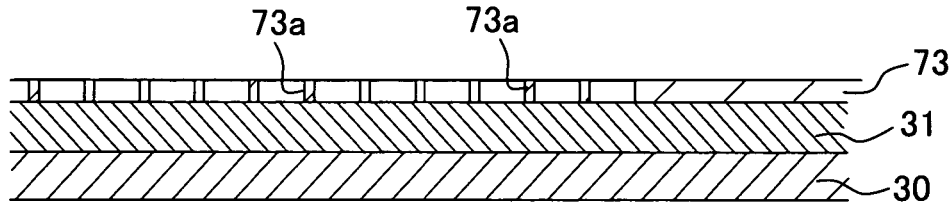
FIG. 14C is a diagram showing a through hole forming step in the producing process.
Figure 14D:
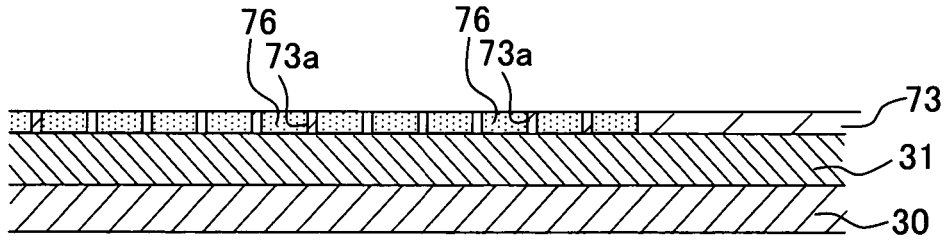
FIG. 14D is a diagram showing a filling step of filling the electroconductive material in the producing process.
Figure 14E:
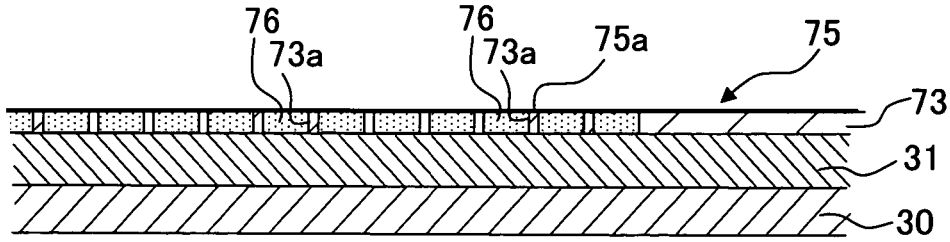
FIG. 14E is a diagram showing a wiring forming step in the producing process.

Further, as shown in FIG. 14C, the plurality of through holes 73*a* is formed in the insulating layer 73 by the laser processing (through hole forming step). Next, as shown in FIG. 14D, by the liquid-droplet discharge method or the screen printing method, the electroconductive material 76 is filled in the through holes 73*a* such that the electroconductive material 76 is reached up to the upper surface of the piezoelectric layer 31 (filling step). Furthermore, as shown in FIG. 14E, the wirings 75 each having the end portion 75*a* which is broad is formed by a method such as the screen printing on the upper surface of the insulating layer 73 (wiring forming step).

In the second embodiment, similarly as in the first embodiment, in the wiring forming step, the plurality of wirings 75 facing the plurality of pressure chambers 14 respectively can be formed at a time on the flat upper surface of the insulating layer 73. Therefore, the forming of these wirings 75 is facilitated. In addition to facilitating the forming of the wirings 75, a step of forming the individual electrodes facing the pressure chambers 14 respectively becomes unnecessary. Therefore, an effect of simplifying the producing process can be also achieved.

Also in the second embodiment, as shown in FIG. 14C, after forming the through holes 73*a* in the insulating layer 73, the wirings 75 may be formed of a material same as the electroconductive material 76 by the screen printing method, on the upper surface of the insulating layer 73 while filling the electroconductive material 76 in the through holes 73*a*. In this case, since it is possible to simultaneously perform the filling of the electroconductive material 76 and the formation of the wirings 75, it is possible to simplify the producing process, and it is advantageous in terms of the producing cost.

Next, a modified embodiment in which various modifications are made in the second embodiment will be explained. The same reference numerals will be used for parts of components having the same structure as those in the second embodiment, and the explanation therefor will be omitted as appropriate.

First Modified Embodiment

Figure 15:
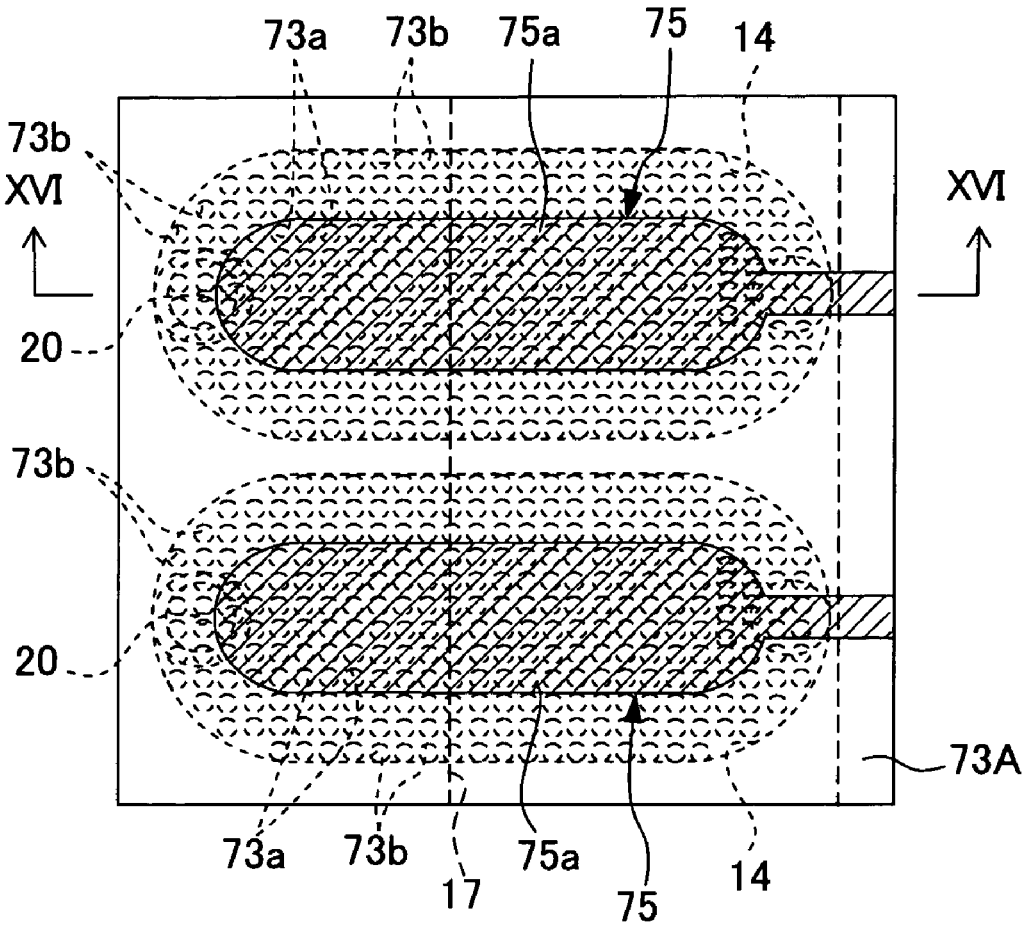
FIG. 15 is a partially enlarged plan view according to a modified embodiment of the second embodiment, corresponding to FIG. 11.
Figure 16:
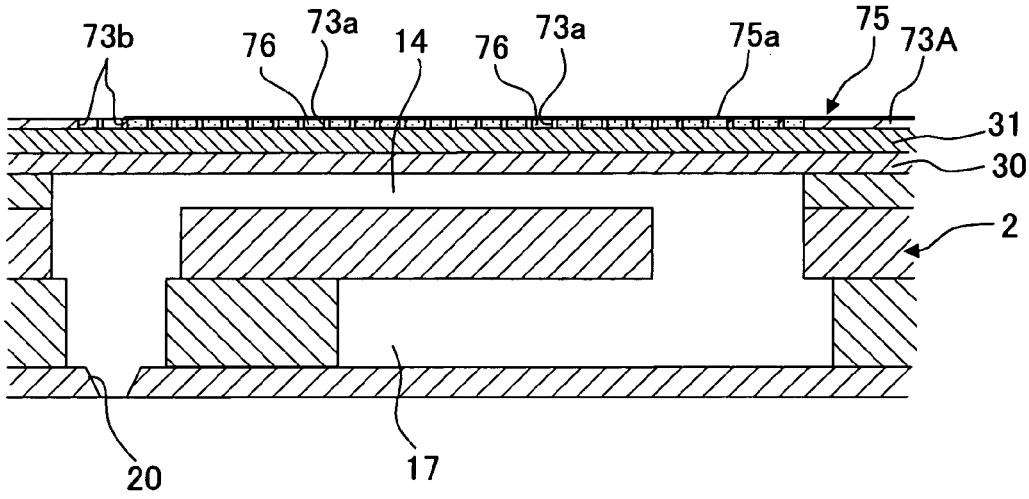
FIG. 16 is a cross-sectional view taken along a line XVI-XVI in FIG. 15.

In the second embodiment, the plurality of through holes 73*a* (first through holes) are formed in the insulating layer 73 only at the area facing the broad end portion 75*a* of one of the wirings 75. As shown in FIGS. 15 and 16, however, a plurality of through holes 73*b* (second through holes) may be formed in an insulating layer 73A even at an area which does not face one of the wirings 75 but faces one of the pressure chambers 14. Thus, by forming the plurality of through holes 73*b* even at the area not facing one of the wirings 75, the insulating layer 73A becomes even more easily to be deformed, and the deformation of the piezoelectric layer 31 is hardly obstructed by the insulating layer 73A. As a matter of course, unlike the through holes 73*a* formed at the area facing one of the wirings 75, the electroconductive material 76 is not filled in the plurality of through holes 73*b* formed at the area not facing one of the wiring 75.

Second Modified Embodiment

Figure 17:
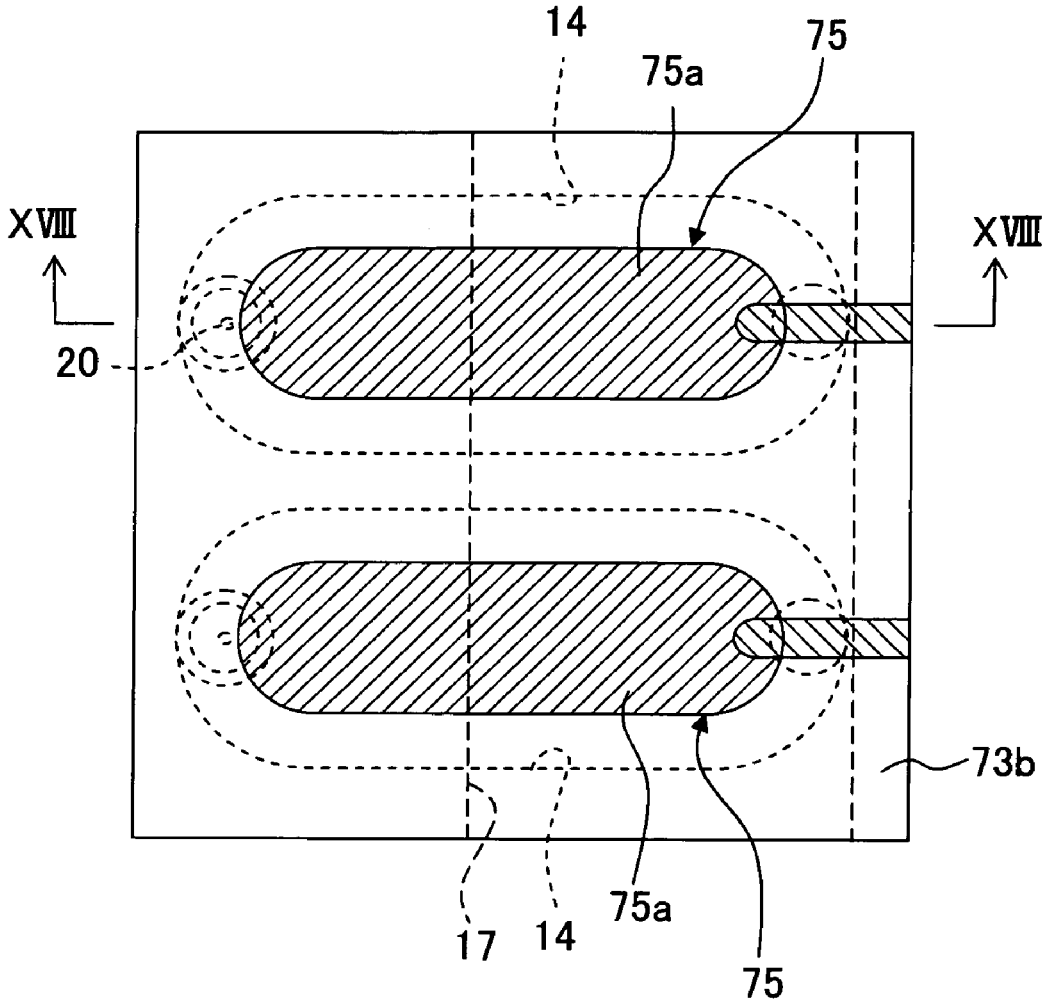
FIG. 17 is a partially enlarged plan view according to another modified embodiment of the second embodiment, corresponding to FIG. 11.
Figure 18:
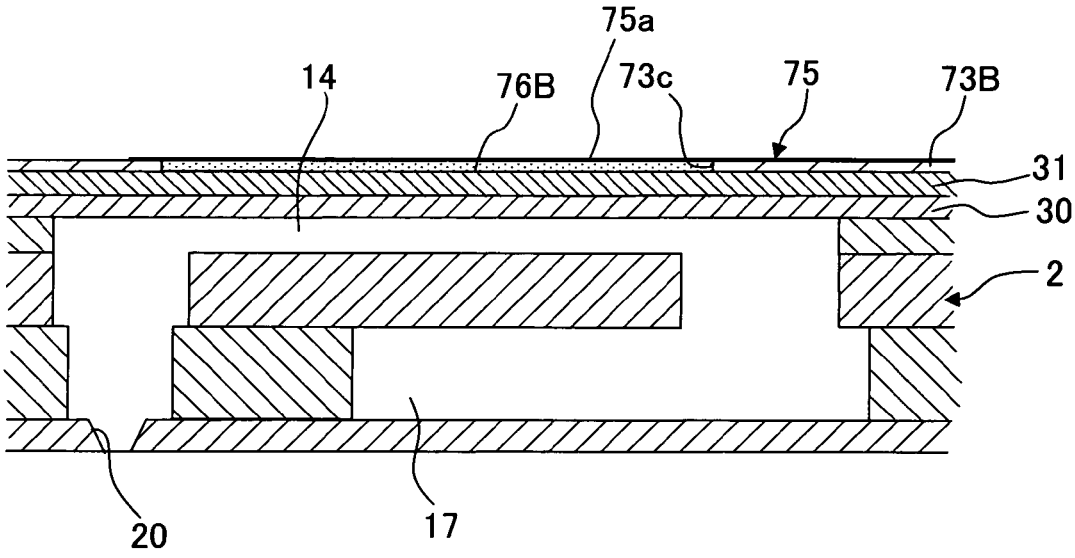
FIG. 18 is a cross-sectional view taken along a line XVIII-XVIII in FIG. 17.

As shown in FIGS. 17 and 18, one through hole 73*c* which has a large diameter and an opening area substantially equal to an area of the end portion 75*a* may be formed in an insulating layer 73B at an area facing the broad end portion 75*a* of one of the wirings 75, and an electroconductive material 76B may be filled in this large diameter through hole 73*c*. In this case, a contact area of the electroconductive material 76B and the piezoelectric layer 31 becomes wider than the contact area in the second embodiment. Therefore, the voltage can be applied even more assuredly to the piezoelectric layer 31.

Third Modified Embodiment

Figure 10:
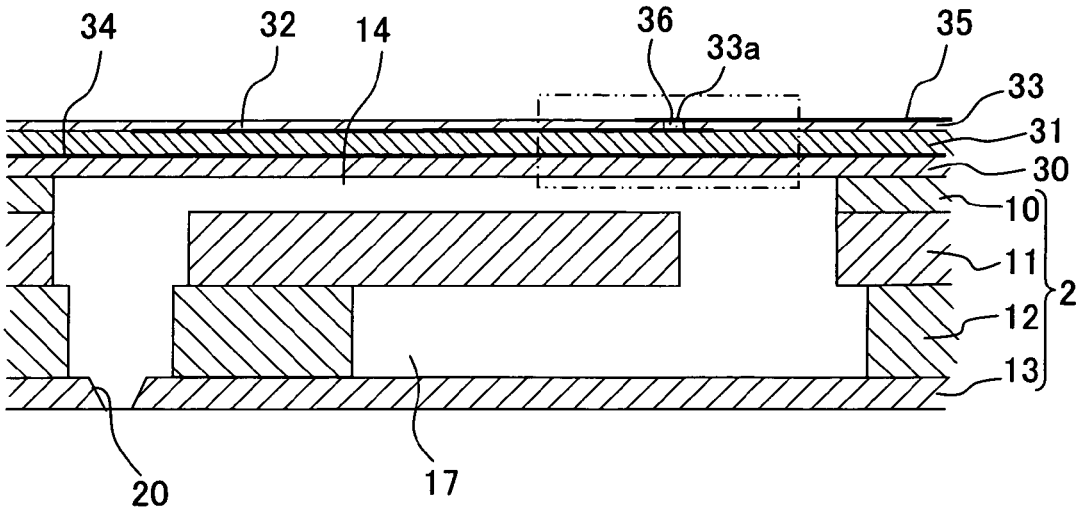
FIG. 10 is a cross-sectional view another modified embodiment of the first embodiment, corresponding to FIG. 4.

Moreover, a modification similar to the modifications made in the first embodiment (the embodiment in which the conducting portion of the driver IC and the vibration plate 30 is formed on the side surfaces of the insulating layer and the piezoelectric layer (see FIG. 9); the embodiment in which the common electrode 34 is provided separately from the vibration plate 30 (see FIG. 10)) can be made in the second embodiment.

The embodiments in which the present invention is applied to the ink-jet head are explained with the examples of the first embodiment and the second embodiment. However, embodiments to which the present invention is applicable are not limited to the first embodiment and the second embodiment. For example, it is also possible to apply the present invention to various liquid transporting apparatuses which transport liquids other than ink.

What is claimed is:

1. A piezoelectric actuator for a liquid transporting apparatus, which is arranged on one surface of a channel unit in which a liquid channel including a plurality of pressure chambers arranged along a plane is formed, and which selectively changes volume of the pressure chambers, the piezoelectric actuator comprising:

a vibrating plate which covers the pressure chambers;

a common electrode which is formed on a surface of the vibration plate on a side opposite to the pressure chambers;

a piezoelectric layer which is arranged continuously on a surface of the common electrode on a side opposite to the pressure chambers, so that the piezoelectric layer wholly covers the pressure chambers thereover;

an insulating layer which is formed entirely on a surface of the piezoelectric layer on a side opposite to the pressure chambers;

wirings which are formed, on a surface of the insulating layer on a side opposite to the pressure chambers, corresponding to the pressure chambers respectively;

a drive unit connected to the wirings, and arranged on the surface of the insulating layer on the side opposite to the pressure chambers, wherein:

a first through hole is formed in the insulating layer at an area facing one of the wirings;

the insulating layer and the piezoelectric layer are adhered tightly without a gap between the insulating layer and the piezoelectric layer; and the first through hole is filled with an electroconductive material which is connected to one of the wirings.

2. The piezoelectric actuator according to claim 1, wherein:

at least a portion of each of the wirings faces a pressure chamber corresponding thereto and included in the pressure chambers;

the first through hole is formed in the insulating layer at an area facing both one of the wirings and one of the pressure chambers; and the electroconductive material filled in the first through hole is reached up to the surface of the piezoelectric layer on the side opposite to the pressure chambers.

3. The piezoelectric actuator according to claim 1, further comprising individual electrodes which correspond to the pressure chambers respectively, wherein:

the insulating layer is formed entirely on the surface of the piezoelectric layer on the side opposite to the pressure chamber without any gap, such that the individual electrodes intervene therebetween;

at least a portion of each of the wirings faces an individual electrode corresponding thereto and included in the individual electrodes;

the first through hole is formed at an area of the insulating layer, the area facing both one of the wirings and one of the individual electrodes; and each of the wirings is connected to one of the individual electrodes by the electroconductive material filled in the first through hole.

4. The piezoelectric actuator according to claim 2, wherein:

each of the wirings has a terminal portion facing a pressure chamber corresponding thereto and included in the pressure chambers;

the terminal portion is formed to be broader than other portion of each of the wirings; and the first through hole is formed as a plurality of through holes at an area of the insulating layer, the area facing the broader terminal portion of one of the wirings.

5. The piezoelectric actuator according to claim 2, wherein a second through hole is formed at an area of the insulating layer, the area facing one of the pressure chambers and facing none of the wirings.

6. The piezoelectric actuator according to claim 2, wherein a coefficient of elasticity of the electroconductive material is smaller than a coefficient of elasticity of the insulating layer.

7. The piezoelectric actuator according to claim 1, wherein the drive unit and the common electrode are connected via a conducting portion straddling over the piezoelectric layer and the insulating layer, the conducting portion extending along a direction in which the piezoelectric layer and the insulating layer are stacked.

8. A liquid transporting apparatus comprising:

a channel unit in which a liquid channel including a plurality of pressure chambers arranged along a plane is formed; and a piezoelectric actuator which is provided on one surface of the channel unit, and which selectively changes volume of the pressure chambers;

wherein the piezoelectric actuator includes:

a vibration plate which covers the pressure chambers;

a common electrode which is formed on a surface of the vibration plate on a side opposite to the pressure chambers;

a piezoelectric layer which is arranged continuously on a surface of the common electrode on a side opposite to the pressure chambers, so that the piezoelectric layer wholly covers the pressure chambers thereover;

an insulating layer which is formed entirely on a surface of the piezoelectric layer on a side opposite to the pressure chambers; and wirings which are formed, on a surface of the insulating layer on a side opposite to the pressure chambers, corresponding to the pressure chambers respectively;

a drive unit connected to the wirings, and arranged on the surface of the insulating layer on the side opposite to the pressure chambers, wherein:

a first through hole if formed in the insulating layer at an area facing one of the wirings;

the insulating layer and the piezoelectric layer are adhered tightly without a gap between the insulating layer and the piezoelectric layer; and the first through hole is filled with an electroconductive material which is connected to one of the wirings.

9. The liquid transporting apparatus according to claim 8, wherein:

at least a portion of each of the wirings faces a pressure chamber corresponding thereto and included in the pressure chambers;

the first through hole is formed in the insulating layer at an area facing both one of the wirings and one of the pressure chambers; and the electroconductive material filled in the first through hole is reached up to the surface of the piezoelectric layer on the side opposite to the pressure chambers.

10. The liquid transporting apparatus according to claim 8, wherein:

the piezoelectric actuator further includes individual electrodes which correspond to the pressure chambers respectively;

the insulating layer is formed entirely on the surface of the piezoelectric layer on the side opposite to the pressure chamber without any gap, such that the individual electrodes intervene therebetween;

at least a portion of one of the wirings faces an individual electrode corresponding thereto and included in the individual electrodes;

the first through hole is formed at an area of the insulating layer, the area facing both one of the wirings and one of the individual electrodes; and each of the wirings is connected to one of the individual electrodes by the electroconductive material filled in the first through hole.

11. The liquid transporting apparatus according to claim 9, wherein:

each of the wirings has a terminal portion facing a pressure chamber corresponding thereto and included in the pressure chambers;

the terminal portion is formed to be broader than other portion of each of the wirings; and the first through holes is formed as a plurality of through holes at an area of the insulating layer, the area facing the broader terminal portion of one of the wirings.

12. The liquid transporting apparatus according to claim 9, wherein a second through hole is formed at an area of the insulting layer, the area facing one of the pressure chambers and facing one of the wirings.

13. The liquid transporting apparatus according to claim 9, wherein a coefficient of elasticity of the electroconductive material is smaller than a coefficient of elasticity of the insulating layer.

14. The liquid transporting apparatus according to claim 8, wherein the drive unit and the common electrode are connected via a conducting portion straddling over the piezoelectric layer and the insulating layer, the conduction portion extending along a direction in which the piezoelectric layer and the insulating layer are stacked.

15. A method of producing the piezoelectric actuator as defined in claim 2, the method comprising:

an insulating layer forming step of forming an insulating layer entirely on a surface of the piezoelectric layer on a side opposite to the vibration plate;

a through hole forming step of forming a first through hole at an area of the insulating layer, the area facing one of the pressure chambers;

a filling step of filling an electroconductive material in the first through hole such that the electroconductive material is reached up to the piezoelectric layer; and a wiring forming step of forming wirings each of which is to be connected to the electroconductive material, on the surface of the piezoelectric layer on the side opposite to the vibration plate.

16. The method of producing the piezoelectric actuator according to claim 15, wherein the filling step and the wiring forming step are performed simultaneously.

* * * * *